US010372152B2

(12) United States Patent
Delbruel

(10) Patent No.: US 10,372,152 B2
(45) Date of Patent: Aug. 6, 2019

(54) DEVICE WITH ASYMMETRIC FEEDBACK

(71) Applicant: Ratier-Figeac SAS, Figeac (FR)

(72) Inventor: Didier Delbruel, Prévinquières (FR)

(73) Assignee: RATIER-FIGEAC SAS, Figeac (FR)

( * ) Notice: Subject to any disclaimer, the term of this patent is extended or adjusted under 35 U.S.C. 154(b) by 0 days.

(21) Appl. No.: 15/480,632

(22) Filed: Apr. 6, 2017

(65) Prior Publication Data

US 2017/0293318 A1 Oct. 12, 2017

(30) Foreign Application Priority Data

Apr. 6, 2016 (EP) ..... 16305398

(51) Int. Cl.

| | |
|---|---|
| ***G05G 7/04*** | (2006.01) |
| ***G05G 5/06*** | (2006.01) |
| ***G05G 17/00*** | (2006.01) |
| ***G05G 5/03*** | (2008.04) |
| *B61H 13/02* | (2006.01) |
| *G05G 1/08* | (2006.01) |

(52) U.S. Cl.

CPC ..... *G05G 7/04* (2013.01); *G05G 5/03* (2013.01); *G05G 5/065* (2013.01); *G05G 17/00* (2013.01); *B61H 13/02* (2013.01); *G05G 1/08* (2013.01); *G05G 2700/18* (2013.01)

(58) Field of Classification Search

CPC ..... G05G 5/03; G05G 5/065; G05G 7/04; G05G 17/00; H01H 19/11

See application file for complete search history.

(56) References Cited

U.S. PATENT DOCUMENTS

| | | | |
|---|---|---|---|
| 3,442,146 A | 5/1969 | Simpson | |
| 3,824,878 A | 7/1974 | Grosseau | |
| 4,661,085 A | 4/1987 | Carli | |

FOREIGN PATENT DOCUMENTS

| | | | | |
|---|---|---|---|---|
| CN | 201129430 Y | 10/2008 | | |
| CN | 101427193 A | 5/2009 | | |
| CN | 102420068 A | 4/2012 | | |
| CN | 103594258 A | 2/2014 | | |
| DE | 102010063409 A1 | 6/2012 | | |
| EP | 1154347 A2 | 11/2001 | | |
| GB | 489962 A | * 8/1938 | | ..... H01H 19/11 |
| JP | S52158279 U | 12/1977 | | |
| JP | 2005126022 A | 5/2005 | | |

OTHER PUBLICATIONS

Extended European Search Report for International Application No. 16305398.6, dated Nov. 18, 2016, 6 pages.
Russian Office Action for Application No. 2017111256/11(019914), dated May 7, 2018, 4 pages.
Chinese Search Report for International Application No. 201710220871.8 dated May 3, 2018, 3 pages.
CN Search Report for Applicaiton No. 201710220871.8, dated Jan. 17, 2019; 3 pages.

* cited by examiner

*Primary Examiner* — Thomas C Diaz
(74) *Attorney, Agent, or Firm* — Cantor Colburn LLP

(57) ABSTRACT

A device for connection to an input device actuated by a user comprises: a driving member for connection to the input device; a follower member; wherein motion of the driving member is only transmitted to the follower member after the driving member has been moved by a certain amount; and wherein means are provided to transmit a force back to the user as the driving member is moved in one direction.

10 Claims, 7 Drawing Sheets

DEVICE WITH ASYMMETRIC FEEDBACK

FOREIGN PRIORITY

This application claims priority to European Patent Application No. 16305398.6 filed Apr. 6, 2016, the entire contents of which is incorporated herein by reference.

TECHNICAL FIELD

The present disclosure relates to a force device where the force transmitted back to an operator differs depending on the position of the device and the direction in which the device is operated.

BACKGROUND

Situations frequently arise where a device (such as a wheel, a handle or a twist grip) is rotated. For example, a twist grip may be rotated by a user to control machinery.

In certain circumstances, it is desired to indicate to a user that actuation of the device to be controlled has begun, and this may be done by varying the amount of force transmitted to the user as a result of operation of the device. The force transmitted back to the user will often increase as the amount of rotation of the device increases. However, it may be desirable to provide a "spike" of increased force, as shown in FIG. 1, so that a user can be made aware that the device is being operated, to avoid inadvertent operation of the device.

The present disclosure seeks to address this issue.

SUMMARY

There is disclosed herein a device for connection to an input device actuated by a user, comprising: a movable driving member for connection to the input device; and a movable follower member; wherein motion of the driving member is only transmitted to the follower member after the driving member has been moved by a certain amount; and wherein means are provided to transmit a force back to the user as the driving member is moved.

Braking means may be provided to prevent motion of the follower member in either direction until motion of the driving member is transmitted to the follower member.

Said driving member and said follower member may be arranged to rotate, with rotation of the driving member only being transmitted to the follower member after the driving member has been rotated by a certain amount.

Said driving member and said follower member may be in the form of plates, which are generally parallel to each other and rotate about an axis generally perpendicular to the plates.

One of the driving member and the follower member may have a projection, and the other of the driving member and the follower member may have an elongate recess, into which the projection fits; such that rotation of the driving member causes the projection to move along the recess until the projection contacts the end of the recess, and further rotation of the driving member causes the follower member to rotate.

Said recess may be in the form of a slot in the driving member or the follower member.

The plates forming the driving member and the follower member may be sector-shaped, and the device may further comprise a roller, which is urged against the edges of the plates by a biasing means such as a spring.

The biasing means may be fixed to a housing of the device.

The edge of the plate forming the driving member may have a profile with a step in it, such that when the step is moved past the roller, the biasing spring is compressed, and this compression is felt by the user as an increase in the force transmitted back to the user.

The step may be located such that the roller contacts the step at or around the point where rotation of the driving member is transmitted to the follower member, such that force is felt by the user as the follower member starts to rotate.

The following member may have a profile with an earlier part and a later part, the roller contacting the later part of the profile of the follower member after the follower member starts to rotate, and the radius of the later part of the profile of the follower member being equal to or greater than the radius of the part of the profile of the driving member after the step.

The radius of the earlier part of the profile of the follower member may increase towards the later part of the profile of the follower member, such that the radius at the start of the earlier part of the profile of the follower member is less than the radius at the start of the profile of the driving member, and the radius at the end of the earlier part of the profile of the follower member is equal to or greater than the radius of the step.

BRIEF DESCRIPTION OF THE DRAWINGS

Some exemplary embodiments of the present disclosure will now be described way of example only and with reference to FIGS. 1 to 11, in which.

DETAILED DESCRIPTION

The device of the invention can be located between an input device and a device to be controlled, but has more general application. The input device may be actuated (more specifically, rotated) by a user, and may be a wheel, a handle or a twist grip.

Figure 1:
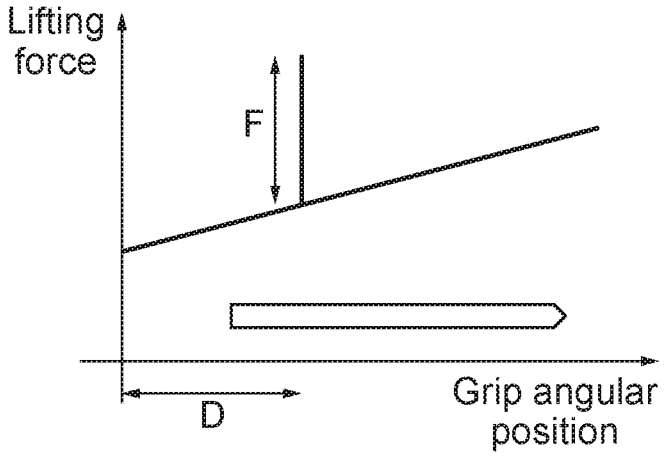
FIG. 1 shows in a highly schematic form the relationship between the force transmitted back to a user and the degree of operation during actuation of a device by movement of an input device.
Figure 2:
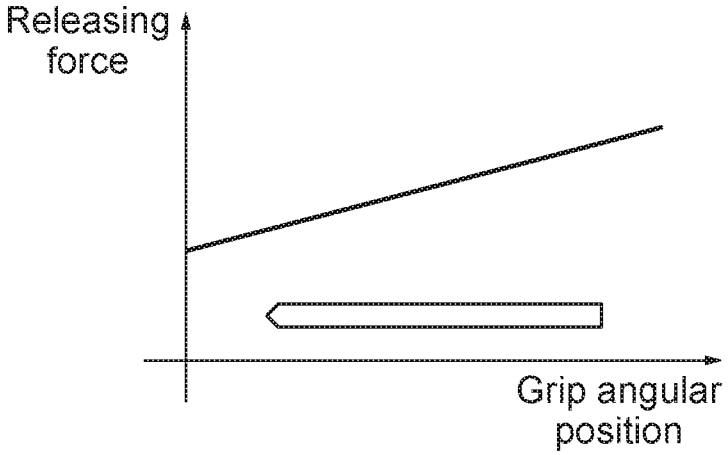
FIG. 2 shows in a highly schematic form the relationship between the force transmitted back to a user and the degree of operation during release of the input device.

As shown in FIGS. 1 and 2, when the user moves the input device, a force is transmitted back to the user. This force is generally consistent with the degree of operation of the input device; however, as shown in FIG. 1, the user experiences a "spike" in the transmitted force (denoted by the reference "F") shortly after he or she starts to move the input device. This "spike" can inform the user that actuation of the device is about to start, and can help avoid accidental actuation. As FIG. 2 shows, there is no such "spike" when the device is being returned to its original position.

FIGS. 1 and 2 show the force transmitted back to the user being generally consistent with the degree of operation of the input device (in that the graph of force against position has a slope). In other forms, the force transmitted back to the user may be generally constant (other than the spike), in which case the graph of force against position will be generally horizontal. The force transmitted back to the user may be zero.

Figure 3:
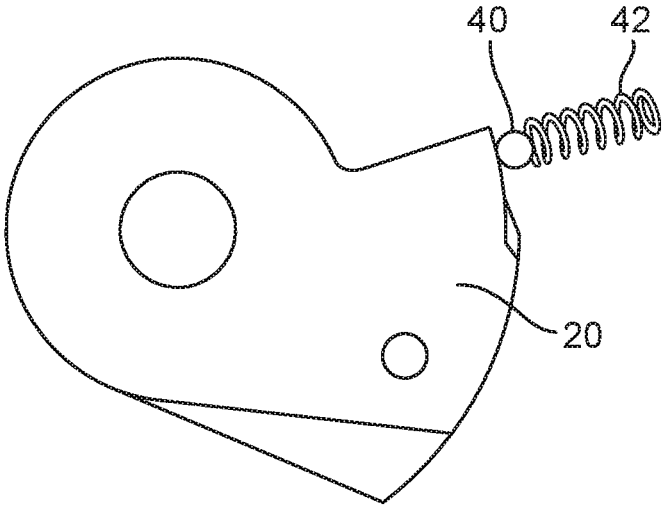
FIG. 3 is a schematic left side view of the device.
Figure 4:
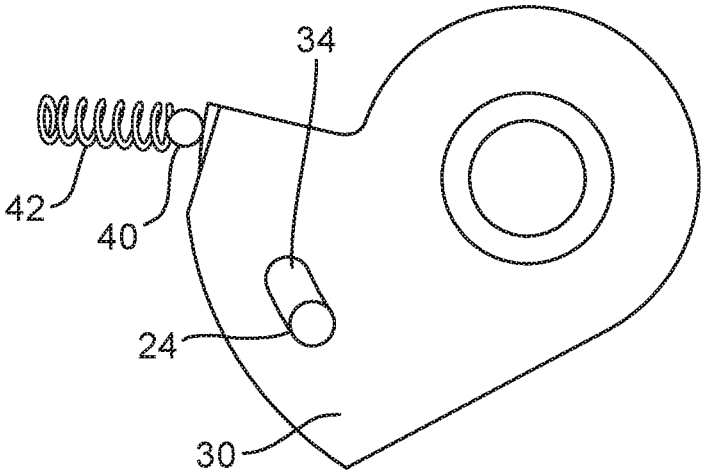
FIG. 4 is a schematic right side view of the device.

As shown in FIGS. 3 and 4 (and also FIGS. 5A, 6A, 7A and 8A), the device 10 includes a driving member 20, that is rotationally connected to the input device, and a follower member 30, which may be connected to a device to be controlled. Rotation of the input device causes the driving member to rotate, and (as will be explained later) rotation of the driving member causes the follower member to rotate. The driving member and the follower member rotate about the same axis, and may for example be mounted on a single shaft.

In the present embodiment, the driving member and the follower member both take the form of sector-shaped plates 22, 32, which can rotate about a common axis. The driving member and the follower member are arranged such that the driving member can rotate by a small degree without causing the follower member to rotate (that is, there is a lost-motion mechanism between the driving member and the follower member).

In the present embodiment, this is achieved by means of a projection 24 on the driving member 20 which projects towards the follower member 30, and is received in a recess 34 in the follower member 30. (It will be appreciated that the projection and the recess could equally well be arranged the other way around, with the projection on the follower member and the recess on the driving member.) The recess 34 is elongate in the radial direction, such that when the driving member 20 rotates, the projection 24 moves along the recess 34 in the follower member 30. As shown in the drawings, the recess 34 may a slot in the follower member 30, and the projection 24 may pass through the slot.

The recess is of limited length, and when the device 10 is in its neutral (un-actuated) state, the projection 24 is located at one end of the recess 34. Initial rotation of the driving member 20 from the neutral state (shown in FIGS. 5A to 5D) will move the projection 24 along the recess 34 until the projection 24 reaches the end of the recess 34 (shown in FIGS. 6A to 6D). The driving member 20 and the follower member 30 are separated so that rotational motion of the driving member 20 does not automatically cause rotational movement of the follower member 30; if necessary, some form of frictional brake may be provided in association with the follower member 30 to prevent movement in either direction.

Further rotation of the driving member 20 will push the projection 24 against the end of the recess 34, and this leads to rotation of the follower member 30. The braking force applied by the brake is relatively weak, and easily overcome by the further rotation of the driving member. Thus, some rotation of the driving member 20 from the neutral state is required before the follower member 30 rotates, during which time the sector-shaped plate 22 of the driving member 20 rotates relative to the sector-shaped plate 32 of the follower member 30.

Although a particular arrangement of the lost-motion mechanism has been described, the skilled person will appreciate that motion can be transmitted between the driving member and the follower member in any suitable way.

As mentioned above, the driving member 20 and the follower member 30 are both in the form of a generally sector-shaped plate 22, 32, and a roller 40 is biased against the edges of the plates 22, 32 by a biasing means 42. In the current embodiment, this biasing means 42 is a mechanical spring, but any suitable device (such as a gas spring) could be used. The edges of the plates 22, 32 function as a cam, with the roller 40 functioning as a cam follower. The spring 42 is fixed to a housing of the device 10, and so does not move when the driving member 20 and the follower member 30 rotate.

As shown in FIG. 3, the profiles of the edges of the plates 22, 32 are generally circular, and so the roller 40 can roll smoothly over the edges of the plates 22, 32 as the plates rotate. (It will be appreciated that the profiles of the edges of the plates 22, 32 move, and the roller 40 is generally stationary; however, as it is easier to visualize the roller 40 moving along the profiles of the edges of the plates 22, 32, this will generally be referred to in the following description.)

However, some regions of the edges of the plates 22, 32 have a non-circular profile, which is shaped to cause the roller 40 to move so as to compress the spring 42. A certain amount of additional force is required to compress the spring 42, and this additional force can be felt by the user holding the input device as the "spike" previously mentioned.

This compression of the spring 42 can take place near the start of the rotation of the input device (and thus near the start of the rotation of the driving member 20), so that a user is informed about the rotation. However, it will be appreciated that the profiles may have any desired shape, to allow compression of the spring to take place at any appropriate point during operation of the device. The "spike" may be felt by the user before the end of the free stroke of the driving member resulting from the lost-motion mechanism. Further, this compression can take place in two or more steps.

The embodiment of the device described with reference to FIGS. 3 to 10 has profiles in which compression of the spring takes place at a single point during actuation of the device, but the skilled person will appreciate that the invention is not limited to this arrangement.

For simplicity, the parts of the profiles which come into contact with the roller 40 during the early parts of the rotation process will be referred to as "earlier parts" or "first parts" of the profiles, and parts of the profiles which come into contact with the roller 40 during later parts of the rotation process will be referred to as "later parts" or "second parts" of the profiles.

Figure 5A:
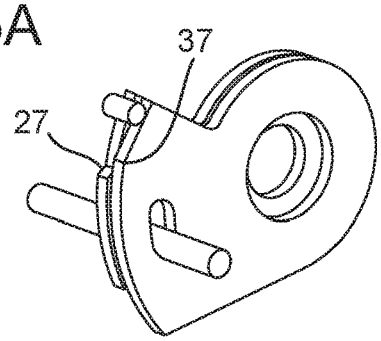
FIGS. 5A to 5D show the device in its neutral (un-actuated) position.
Figure 5B:
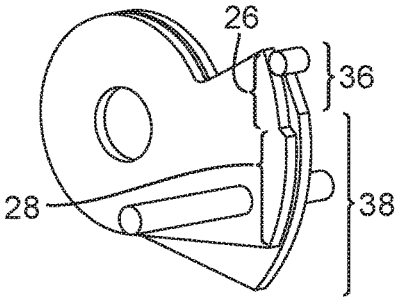
Figure 5C:
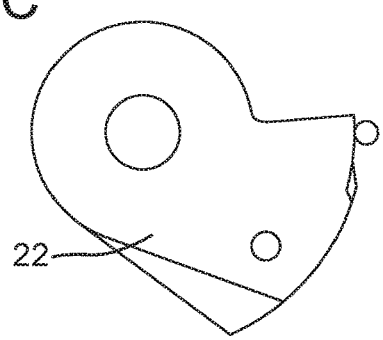
Figure 5D:
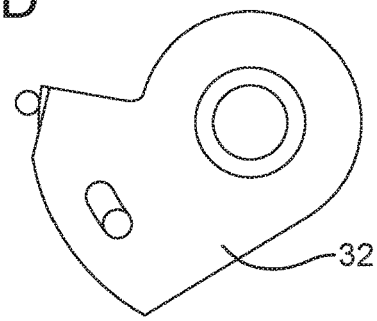
Figure 6A:
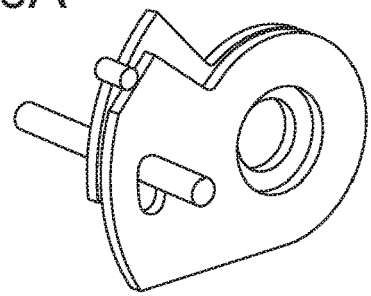
FIGS. 6A to 6D show the device in a state where motion of the driving member is about to be transmitted to the follower member, with an associated spike in the force transmitted back to the user.
Figure 6B:
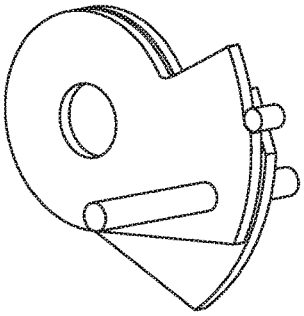
Figure 6C:
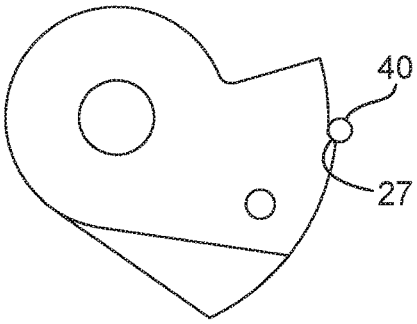
Figure 6D:
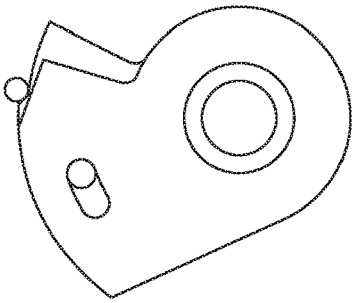
Figure 7A:
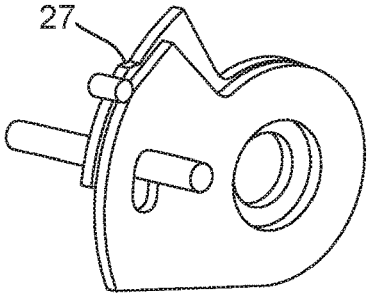
FIGS. 7A to 7D show the device in a state where the driving member and follower member are moving together.
Figure 7B:
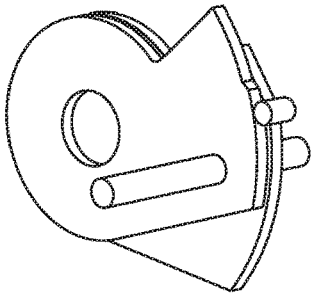
Figure 7C:
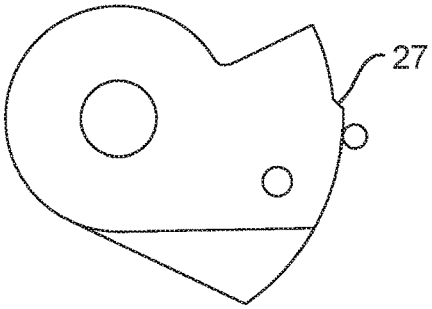
Figure 7D:
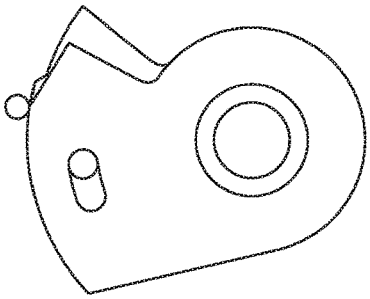
Figure 8A:
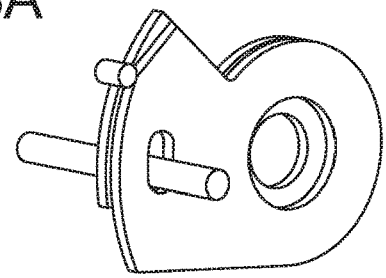
FIGS. 8A to 8D show the device in a state where it is returning to its original neutral position.
Figure 8B:
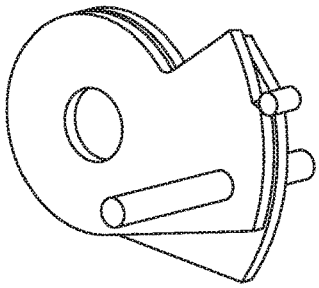
Figure 8C:
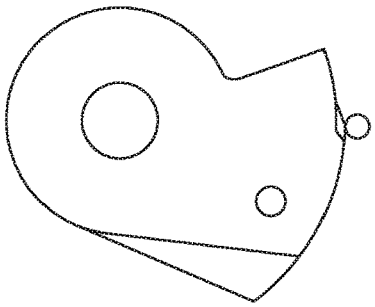
Figure 8D:
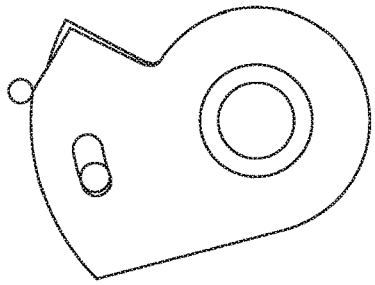
Figure 9:
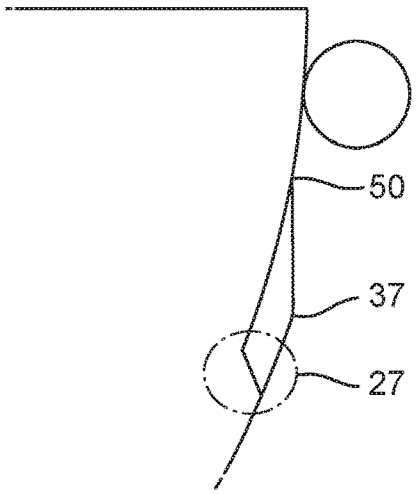
FIG. 9 is a close-up side view of early parts of the profiles of the driving member and the follower member, when the device is in its neutral (un-actuated) position.
Figure 10:
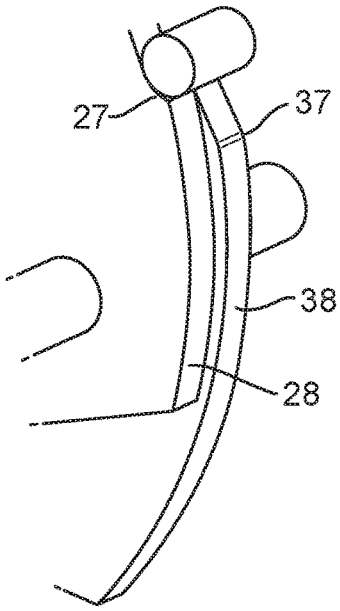
FIG. 10 is a perspective view of the profiles of the driving member and the follower member.

As best shown in FIGS. 5A and 5B, the driving member 20 has a profile which includes a first part 26 of constant radius and a second part 28 of constant radius, wherein the radius of the second part 28 is slightly greater than the radius of the first part 26. The first part 26 and the second part 28 are connected by a step 27, which the roller 40 can roll up.

As the roller 40 rolls up the step 27, the biasing spring 42 is compressed, to provide the "spike".

In this embodiment, the driving member 20 and follower member 30 are arranged such that when the driving member 20 is rotated by operation of the input device, the step 27 on the driving member 20 reaches the roller 40 at the same time as (or very slightly earlier than) the projection 24 on the driving member 20 reaches the end of the recess 34 in the follower member 30. Thus, the user feels the "spike" as (or just before) the follower member 30 starts to move. If the user is operating the input device inadvertently, then this "spike" will inform them of the operation, and they can then return the input device to its original (un-actuated) state.

However, if the user is operating the input device deliberately, then they will continue to rotate the input device after the "spike". As explained above, this will lead to rotation of the follower member 30.

In this embodiment, the "spike" occurs as the follower member starts to rotate. However, as explained above, the invention is not limited to this, and a spike can occur before or after the follower member starts to rotate. Further, the driving member and follower member may be arranged so that the user feels more than one spike during operation.

The earlier part 36 of the profile of the follower member 30 is a sector of gradually increasing radius, and the later part 38 of the profile of the follower member 30 is a sector of constant radius. The two parts 36, 38 of the profile of the follower member are joined smoothly (at point 37).

The radius at the start of the earlier part 36 of the profile of the follower member 30 is smaller than the radius of the first part 26 of the profile of the driving member 20. Further, the radius of the later part 38 of the profile of the follower member 30 is equal to, or (preferably) very slightly greater than, the radius of the second part 28 of the profile of the driving member 20. Since the earlier part 36 and the later part 38 of the profile of the follower member 30 are joined smoothly, it follows that the radius at the end of the earlier part 36 of the profile of the follower member 30 is the same as the radius of the later part 38 of the profile of the follower member 30, and so is also equal to or very slightly greater than the radius of the second part 28 of the profile of the driving member 20. Thus, the radius of the earlier part 36 of the profile of the follower member 30 increases, from being smaller than the radius of the first part 26 of the profile of the driving member 20 to being equal to very slightly greater than the radius of the second part 28 of the profile of the driving member 20.

When the follower member 30 is made to rotate as a result of continued rotation of the driving member 20 (as shown in FIGS. 6A to 6D, which show the state where the projection 24 on the driving member 20 reaches the end of the recess 34 formed in the follower member 30, and FIGS. 7A to 7D, which show that both the driving member 20 and the follower member 30 have rotated from the corresponding positions in FIGS. 6A to 6D), the roller 40 moves along the start of the second part 28 of the profile of the driving member 20. The roller 40 then contacts the end of the earlier part 36 of the profile of the follower member 30, which as mentioned above has a radius which is equal to or very slightly greater than the radius of the second part 28 of the profile of the driving member 20. If the radius of the end of the earlier part 36 of the profile of the follower member is very slightly greater than the radius of the second part 28 of the profile of the driving member 20, this compresses the biasing spring 42 very slightly; however, the compression is sufficiently small that it does not cause the user to feel a spike in the force transmitted back to the user.

The roller 40 then moves over the smooth joint 37 between the earlier part 36 and the later part 38 of the profile of the follower member 30, and subsequent rotation of the driving member 20 and the follower member 30 continues to move the roller 40 over the later part 38 of the profile of the follower member 30. As this part of the profile of the follower member 30 has a constant radius, there is no further compression of the biasing spring 42.

In an alternative form, the later part 38 of the profile of the follower member 30 may have a radius which gradually increases. With this arrangement, the spring 42 will be gradually compressed as the roller 40 moves over the later part 38 of the profile of the follower member 30, and so the force required to gradually compress the spring 42 will be felt by the user as a gradually increasing feedback force.

Similarly, the first part 26 of the profile of the driving member 20 need not be circular, and may also have a radius which gradually increases, so that the user will feel a gradually increasing feedback force in the initial part of the rotation of the driving member.

Figure 11:
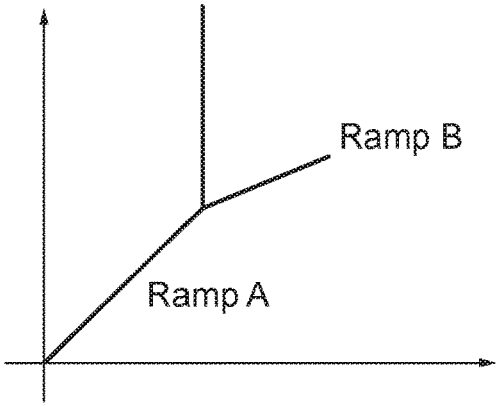
FIG. 11 is a view similar to FIG. 1, but shows a different relationship between the force transmitted back to a user and the degree of operation.

If both the first part 26 of the profile of the driving member 20 and the later part 38 of the profile of the follower member 30 have radii which increase, then the user will feel a gradually increasing feedback force throughout the rotation of the driving member. If the rates of increase of the radii are different, then the user will feel a change in the amount of increase of the feedback force, as schematically shown in FIG. 11. The first part 26 of the profile of the driving member 20 corresponds to "Ramp A" and the later part 38 of the profile of the follower member 30 corresponds to "Ramp B". If this change is sufficiently evident, then it may not be necessary to provide a "spike" in the feedback force, and so it may be possible to dispense with the step 27.

When the device is to be returned to its original state, the input device is rotated in the opposite direction, and this will rotate the driving member 20 back towards its original position. Since the driving member 20 and the follower member 30 are not in contact (other than by means of the projection 24 and the recess 34), and the movement of the follower member is braked by the frictional brake, rotational motion of the driving member 20 does not cause rotational movement of the follower member 30, and so the follower member 30 initially does not move. The roller 40 thus remains in contact with the same point on the profile of the follower member 30.

However, the projection 24 on the driving member 20 will be moved back along the recess 34 in the follower member 30, until it comes into contact with the end of the recess 34 where it was originally located (as shown in FIGS. 8A to 8D). At this point, the relative positions of the driving member 20 and follower member 30 will be the same as when motion of the driving member 20 originally started (as can be seen by comparing FIGS. 5A to 5D with FIGS. 8A to 8D). However, the rotational positions of the driving member 20 and the follower member 30 relative to the roller 40 are different (as can again be seen by comparing FIGS. 5A to 5D with FIGS. 8A to 8D).

Subsequent rotation of the driving member 20 towards its original position will overcome the braking force of the frictional brake and will move the follower member 30, and as a result, the roller 40 will move over the profiles of the driving member 20 and the follower member 30.

Since the radius of the later part 38 of the profile of the follower member 30 is greater than the radius of the second part 28 of the driving member 20, the roller will move along the profile of the follower member 30 as the driving member 20 and the follower member 30 are rotated back to their original positions. Further, the roller 40 will move over the smooth joint 37 between the later part 38 and the earlier part 36 of the profile of the follower member 30 (as can be seen from FIG. 9), and will then move along the earlier part 36 of the profile of the follower member 30.

As mentioned above, the radius of the earlier part 36 of the profile of the follower member 30 gradually reduces, until it is less than the radius of the first part 26 of the profile of the driving member 20. Thus, the roller 40 will move along the earlier part 38 of the profile of the follower member 30 until the point where the reducing radius is equal to the radius of the first part 26 of the profile of the driving member 20 (point 50 in FIG. 9). Continued motion of the driving member 20 and follower member 30 will then move the roller 40 along the first part 26 of the profile of the driving member 20, until the roller eventually arrives back at its original position (as shown in FIGS. 5A to 5D).

During the return motion of the roller 40, the biasing spring 42 is gradually uncompressed. At no point in the return motion is the spring 42 compressed further, and so there is no "spike" in force on the return path, as can be seen from FIG. 2. However, in alternative embodiments, the profiles of the driving member and the follower member could be arranged so as to include a step, and thus provide a "spike" in force during the return path if appropriate or desired.

Means (not shown) can be provided to bias the driving member 20 into its un-actuated position, so that the device 10 returns to its neutral (un-actuated) state when the user releases the input device. These means could take the form of a coil spring or the like, arranged around the shaft on which the driving member 20 and the follower member 30 rotate. These means are preferably relatively weak, so that the bias that they exert can easily be overcome by a user of the device.

Further, in the embodiment described above, the driving member is rotationally connected to an input device, and the driving member and the follower member rotate about the same axis. However, it is also possible for the driving member and the follower member to move in a straight line. The driving member and the follower member may be in the form of generally rectilinear plates (or plates of any suitable shape, depending on the particular application of the device), with an edge of each plate forming the profiles of the driving member and the follower member.

The device provides feedback to a user to inform them of actuation of the device, and thus helps to avoid inadvertent actuation, with a simple construction.

The invention claimed is:

1. A device for connection to an input device actuated by a user, comprising:

a movable driving member for connection to the input device; and a movable follower member;

wherein said moveable driving member and said moveable follower member are arranged to rotate, and rotation of the driving member is only transmitted to the moveable follower member after the moveable driving member has been rotated by a certain amount;

wherein the connection between the moveable driving member and the input device is arranged to transmit a force back to the user as the movable driving member is moved such that there is a spike in force transmitted back to the user after the movable driving member has been moved by a certain rotation away from an original position, with the spike in force including an increase in the force transmitted back to the user followed by a decrease in force as the rotation of the moveable driving member continues, and wherein there is no such spike in force when the device is rotated by the user back to the original position.

2. A device as claimed in claim 1, wherein a brake is provided in association with the movable follower member, the brake being configured to prevent the moveable follower member from moving in either direction until motion of the driving member is transmitted to the moveable follower member.

3. A device as claimed in claim 1, wherein said moveable driving member and said moveable follower member are in the form of plates, which are generally parallel to each other and rotate about the same axis generally perpendicular to the plates.

4. A device as claimed in claim 1, wherein:

one of the moveable driving member and the moveable follower member has a projection;

the other of the moveable driving member and the moveable follower member has an elongate recess, into which the projection fits;

such that rotation of the moveable driving member causes the projection to move along the recess until the projection contacts the end of the recess, and further rotation of the moveable driving member causes the moveable follower member to rotate.

5. A device as claimed in claim 4, wherein said recess is in the form of a slot in the moveable driving member or the moveable follower member.

6. A device as claimed in claim 3, wherein the plates forming the moveable driving member and the moveable follower member are sector-shaped, and the device further comprises a roller, which is urged against the edges of the plates by a biasing means.

7. A device as claimed in claim 6, wherein the edge of the plate forming the moveable driving member has a profile with a step in it, such that when the step is moved past the roller, the biasing means is compressed, and this compression is felt by the user as an increase in the force is transmitted back to the user.

8. A device as claimed in claim 7, wherein the step is located such that the roller contacts the step of the moveable driving member at about the point where rotation of the moveable driving member is transmitted to the moveable follower member, such that force is felt by the user as the moveable follower member starts to rotate.

9. A device as claimed in claim 7, wherein the moveable follower member has a profile with an earlier part and a later part, and the radius of the later part of the profile of the moveable follower member being equal to or greater than the radius of the part of the profile of the moveable driving member after the step.

10. A device as claimed in claim 9, wherein the radius of the earlier part of the profile of the moveable follower member increases towards the later part of the profile of the moveable follower member, such that the radius at the start of the earlier part of the profile of the moveable follower member is less than the radius at the start of the profile of the moveable driving member, and the radius at the end of the earlier part of the profile of the moveable follower member is equal to or greater than the radius of the step.

* * * * *